US010309380B2

(12) United States Patent
MacHarg

(10) Patent No.: US 10,309,380 B2
(45) Date of Patent: Jun. 4, 2019

(54) ROTARY AXIAL PISTON PUMP

(75) Inventor: John P. MacHarg, Ventura, CA (US)

(73) Assignee: Ocean Pacific Technologies, Ventura, CA (US)

( * ) Notice: Subject to any disclaimer, the term of this patent is extended or adjusted under 35 U.S.C. 154(b) by 1144 days.

(21) Appl. No.: 13/298,250

(22) Filed: Nov. 16, 2011

(65) Prior Publication Data

US 2013/0118346 A1 May 16, 2013

(51) Int. Cl.
*F04B 1/14* (2006.01)
*F04B 1/20* (2006.01)

(52) U.S. Cl.
CPC ..... *F04B 1/146* (2013.01); *F04B 1/2078* (2013.01); *F05C 2203/08* (2013.01); *F05C 2203/0804* (2013.01)

(58) Field of Classification Search
CPC ..... F04B 1/324; F04B 1/22; F04B 1/2035; F04B 1/126; F03C 1/0686; F16D 31/02; F02G 2270/20; F05C 2203/08
USPC ..... 92/57, 12.2, 71
See application file for complete search history.

(56) References Cited

U.S. PATENT DOCUMENTS 3,657,970 A 4/1972 Kobayashi et al.
3,893,375 A 7/1975 Hein et al.
4,644,850 A * 2/1987 Kanamaru ..... F04B 27/0821 417/269
4,732,047 A 3/1988 Kato et al.
5,013,219 A 5/1991 Hicks et al.
5,102,310 A 4/1992 Gander et al.
5,392,693 A * 2/1995 Engel et al. ..... 92/248
(Continued)

FOREIGN PATENT DOCUMENTS

CN 2066509 U 8/1990
JP 58172478 A * 10/1983 ..... F04B 1/00
(Continued)

OTHER PUBLICATIONS

PCT; International Search Report and Written Opinion Issued in Corresponding International Patent Application No. PCT/US2012/065609; dated Mar. 26, 2013; 8 Pages.
(Continued)

*Primary Examiner* — Justin D Seabe
*Assistant Examiner* — Jason Mikus
(74) *Attorney, Agent, or Firm* — Fitch, Even, Tabin & Flannery LLP

(57) ABSTRACT

RAPPs comprise a housing, a swash plate with an inclined surface, and a rotor assembly positioned adjacent the swash plate. The swash plate and/or the inclined surface are ceramic. The rotor assembly comprises a rotor-drum having at least one cylinder bore having a piston disposed therein, wherein the piston has a ball-shaped end. A slipper is interposed between the swash plate and the rotor-drum, and includes a socket joint for accommodating the piston ball-shaped end therein. A plastic material may be disposed within the socket joint. The slipper has a ceramic interface surface in contact with the inclined surface. A stator plate is positioned in the housing, and a rotor plate is interposed between the stator plate and the rotor-drum. The stator plate has a ceramic interface surface in contact with the rotor plate. The rotor plate has a ceramic interface surface in contact with the stator plate.

17 Claims, 4 Drawing Sheets

(56) References Cited

U.S. PATENT DOCUMENTS

| | | | | |
|---|---|---|---|---|
| 5,520,088 | A | 5/1996 | Dixen | |
| 5,540,139 | A | 7/1996 | Martensen et al. | |
| 5,554,009 | A | 9/1996 | Ohta et al. | |
| 5,573,380 | A | 11/1996 | Martensen et al. | |
| 5,584,228 | A | 12/1996 | Jepsen | |
| 5,588,347 | A | 12/1996 | Jepsen | |
| 5,598,761 | A | 2/1997 | Kristensen et al. | |
| 5,601,009 | A | 2/1997 | Jepsen et al. | |
| 5,622,097 | A | 4/1997 | Martensen et al. | |
| 5,671,653 | A | 9/1997 | Martensen et al. | |
| 5,704,272 | A | 1/1998 | Durako, Jr. et al. | |
| 5,737,996 | A | 4/1998 | Hansen | |
| 5,752,428 | A | 5/1998 | Jepsen | |
| 5,758,566 | A | 6/1998 | Jepsen et al. | |
| 5,762,477 | A | 6/1998 | Jepsen et al. | |
| 5,778,757 | A | 7/1998 | Kristensen et al. | |
| 5,784,951 | A | 7/1998 | Moller | |
| 5,794,513 | A | 8/1998 | Kristensen | |
| 5,813,315 | A | 9/1998 | Kristensen et al. | |
| 5,868,061 | A | 2/1999 | Hansen et al. | |
| 5,890,412 | A | 4/1999 | Martensen et al. | |
| 5,947,003 | A | 9/1999 | Jepsen et al. | |
| 6,000,316 | A | 12/1999 | Moller et al. | |
| 6,162,030 | A * | 12/2000 | Pierrat | 417/497 |
| 6,217,289 | B1 | 4/2001 | Smith | |
| 6,405,634 | B1 | 6/2002 | Hansen | |
| 6,648,605 | B2 | 11/2003 | Nelson | |
| 7,052,246 | B1 | 5/2006 | Plug et al. | |
| 7,188,562 | B2 | 3/2007 | Hansen et al. | |
| 7,263,925 | B1 | 9/2007 | Hansen et al. | |
| 7,794,212 | B2 | 9/2010 | Hugelman | |
| 7,806,040 | B2 | 10/2010 | Peterson | |
| 7,862,307 | B2 | 1/2011 | Watanabe et al. | |
| 7,963,209 | B2 * | 6/2011 | Olsen et al. | 92/12.2 |
| 2004/0216601 | A1 | 11/2004 | Matsumoto et al. | |
| 2005/0180860 | A1 | 8/2005 | Dewispelaere et al. | |
| 2005/0207905 | A1 | 9/2005 | Koelzer et al. | |
| 2007/0022873 | A1 | 2/2007 | Sund et al. | |
| 2007/0039157 | A1 | 2/2007 | Rateick, Jr. et al. | |
| 2009/0129949 | A1 | 5/2009 | Stoelzer | |
| 2010/0282070 | A1 | 11/2010 | Ishikawa et al. | |

FOREIGN PATENT DOCUMENTS

| | | | |
|---|---|---|---|
| JP | S58172478 | A | 10/1983 |
| JP | 05-027286 | | 4/1993 |
| JP | H11210616 | A | 8/1999 |
| WO | WO 95/22001 | | 8/1995 |
| WO | 9937917 | A1 | 7/1999 |

OTHER PUBLICATIONS

First Notification of Office Action, dated Sep. 30, 2015 for Chinese Application No. 201280061828.7 with English translation (19 pgs.).
Search Report—Patent by Danish Patent and Trademark Office, dated Jul. 28, 2015 for Application No. PA201470327 (2 pgs.).
Search Opinion—Patent by Danish Patent and Trademark Office, dated Aug. 10, 2015 for Application No. PA201470327 (2 pgs.).
Second Notification of Office Action, dated Jul. 28, 2016 for Chinese Application No. 201280061828.7 with English translation (19 pages).
Response filed with the Danish Patent and Trademark Office, dated Jun. 10, 2016 for Danish Application No. PA201470327 (38 pages).
Second Technical Examination by Danish Patent and Trademark Office, dated Jul. 29, 2016 for Danish Application No. PA201470327 (3 pages).
Response filed with the Danish Patent and Trademark Office, dated Feb. 9, 2017 for Danish Application No. PA201470327 (36 pages).
Third Technical Examination by Danish Patent and Trademark Office, dated Feb. 23, 2017 for Danish Application No. PA201470327 (2 pages).
Response filed with the Danish Patent and Trademark Office, dated Dec. 22, 2017 for Danish Application No. PA201470327 (11 pages).
Fourth Technical Examination-Intention to Grant by Danish Patent and Trademark Office, dated Jan. 19, 2018 for Danish Application No. PA201470327 (2 pages).

* cited by examiner

ROTARY AXIAL PISTON PUMP

FIELD OF THE INVENTION

This invention relates to rotary axial piston pumps and, more specifically, to rotary axial piston pumps that are specifically engineered to operate in plain water applications in a manner that provides improved service life and more robust operation criteria when compared to conventional rotary axial piston pumps.

BACKGROUND

Rotary axial piston pumps (RAPPs) are known in the art and can be constructed for a number of different end-use applications. One category of RAPPs are configured for use in applications, e.g., oil hydraulic transport, that permit the internal components that are subjected to friction to be oil lubricated, thereby helping to reduce the unwanted effects of friction to provide a desired service life.

Another category of RAPPs are configured for use in applications, e.g., water hydraulic transport, that do not permit the internal components subjection to friction to be oil lubricated. In such applications, the RAPPs are configured to use plain water without additives or aides as the only friction lubricating medium.

Conventional RAPPs configured for water hydraulic transport service use internal parts, subjected to friction during use, that are specifically configured to include a polymeric low-friction surface feature. Such a conventional RAPPs comprise metallic piston slippers that include a polymeric surface feature that projects outwardly a small distance from the slipper body metal interface surface. As the piston rotates against a metallic swash plate during RAPP operation, and the polymeric surface feature operates to prevent metal-to-metal contact, thereby reducing friction.

While such RAPPs are configured to address frictional wear effects between adjacent metallic parts during water hydraulic transport use, the use of such RAPPs configured in the manner described require that the water entering the pump be filtered to very high level to remove particulate matter. If unfiltered, the particulate matter in the water can otherwise wear and/or damage polymeric surface feature resulting in metal-to-metal contact, thereby reducing the effective service life of the RAPP. The need to filter the water transported by the RAPPs to protect against unwanted damage and/or reduced service life involves using filtration equipment that adds labor and material costs to the overall cost of operating such RAPPs.

Thus, while RAPPs configured for water transport service are constructed to provide some degree of low friction operation under certain operating conditions, e.g., ultra-clean conditions, it is desired that an RAPP be constructed in a manner that permits a more robust operating parameters in water transport services in terms of both improved service life and in terms of reduced water pretreatment requirements. Specifically, it is desired that an RAPP be constructed in a manner comprising internal parts specially developed and engineered to provide an improved degree of friction reduction performance, thereby extending service life when compared to conventional water transport RAPPs.

It is further desired that such RAPPs comprising such construction provide the improved degree of friction reduction performance in a manner that avoids the need to filter the incoming water to ultra-fine standards, thereby reducing the overall equipment and labor costs associated with RAPP operation. Finally, it is desired that such RAPP be constructed in a manner avoiding the use of exotic materials and/or nonconventional manufacturing techniques, thereby minimizing any such impact on material and manufacturing costs.

SUMMARY OF THE INVENTION

RAPPs as disclosed herein comprise a housing, a swash plate that includes an inclined surface, and a rotor assembly that is positioned adjacent the swash plate. In an example embodiment, the inclined surface can be formed from a ceramic material and/or the entire swash plate can be formed from a ceramic material. The rotor assembly comprises a rotor-drum that has at least one cylinder bore disposed therein, and that has piston(s) disposed within the respective cylinder bore(s). The pistons are constructed having a ball-shaped end that extends from the cylinder bore(s).

Such RAAPs further comprise at least one slipper that is interposed between the swash plate and the rotor-drum. The slipper(s) comprises socket joints for accommodating the piston ball-shaped end(s) therein. The socket joint may comprise a plastic material disposed therein that is in contact with the piston ball-shaped end. The slipper(s) further include a swash plate interface surface that is in contact with the swash plate inclined surface and that is formed from a ceramic material. In an example embodiment, the slipper may be formed from a ceramic material. In an example embodiment, the slipper and socket joint are configured in the form of a molded together construction.

The RAAPs also includes a stator plate that is positioned adjacent an end block that is disposed in the housing open end, and a rotor plate that is interposed between the stator plate and the rotor-drum. In an example embodiment, the stator plate comprises an interface surface that is in contact with the rotor plate, and that is formed from ceramic material. In an example embodiment, the rotor plate comprises an interface surface that is in contact with the stator plate, and that is formed from a ceramic material. In an example embodiment, the stator plate and/or the rotor plate may be formed entirely from a ceramic material.

In an example embodiment, the RAAPs comprise a pressure plate that is in contact with the slippers. A spring may be in contact with the pressure plate, and the spring may be disposed within a central cavity in the rotor-drum interposed between a closed end of the cavity and the pressure plate. In an example embodiment, the RAAPs may further comprise a plurality of retainers disposed on top of respective slippers and interposed between the slippers and the pressure plate.

DETAILED DESCRIPTION OF THE DRAWINGS

The above and further objects, features and advantages of RAPPs as disclosed herein will be more fully understood and appreciated from the following description taken in conjunction with reference to the accompanying drawings in which.

DETAILED DESCRIPTION

RAPPs as disclosed herein are specially engineered to provide an improved service life in water hydraulic transport service without the need for ultra-fine filtration requirements. RAPPs as disclosed herein include one or more internal parts that are formed from a ceramic material for the purpose of reducing and controlling unwanted frictional effects between dynamically engaged surfaces. Depending on the particular internal part, the entire part can be formed from a ceramic material, or only a portion of the part can be formed from a ceramic material.

Figure 1:
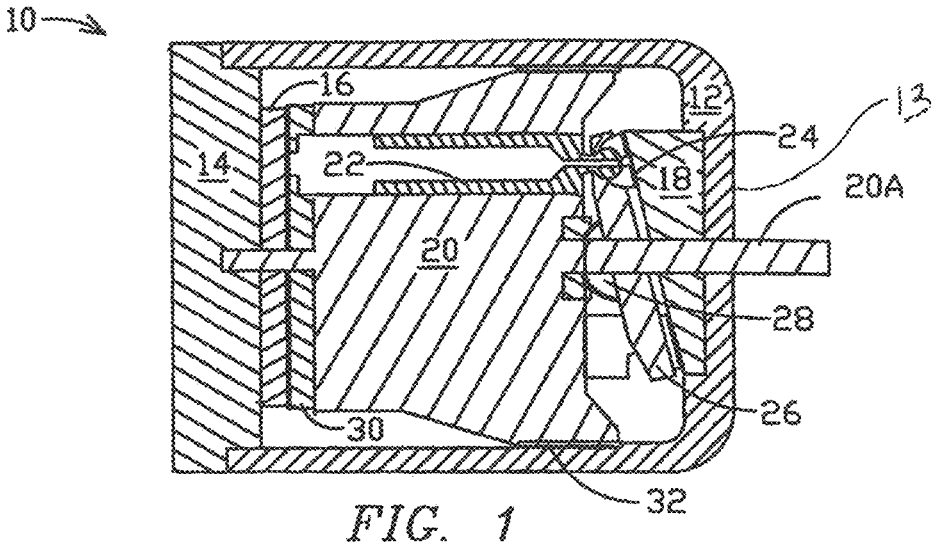
FIG. 1 PRIOR ART
FIG. 1 illustrates a cross-sectional side view of a prior art RAPP.

FIG. 1 illustrates a prior art RAPP for purpose of reference and understanding the basic internal operating components thereof. FIG. 1 is a simplified cross-sectional representation of a prior art RAPP 10 taken across one vertical plane. The RAPP 10 comprises a stator assembly including a housing 12 having a generally closed first end 13 at one axial end, and having an end block 14 attached to an otherwise opposed open end of the housing.

A stator plate 16 is disposed within the housing 12 and is positioned adjacent an inside surface of the end block 14. The stator plate is a metallic stationary member that does not rotate relative to the housing. A swash plate 18 is disposed within the housing and positioned adjacent an inside surface of the housing closed end 13. The swash plate is also a metallic stationary member that does not rotate relative to the housing and provides a smooth flat inclined surface that extends towards the stator plate.

A rotor assembly is disposed within the housing and comprises a cylindrical rotor-drum 20 that is interposed between the stator plate and the swash plate. The rotor-drum is configured to rotate within the housing and comprises an array of axial cylinder bores, each fitted with an axial piston 22. Each axial piston comprises a ball-shaped end in swivel engagement with a slider shoe or slipper 24 held against the inclined surface of swash-plate 18. The slipper comprises a metallic body and swash plate interface surface.

Slider shoes 24 are supported in a uniform array and held against swash-plate 18 by a shoe pressure plate 26, which bears against the central region of rotor-drum 20 via a hemispherical swivel member 28. At the other end of rotor-drum 20, an attached rotor plate 30 interfaces stator plate 16 at a sliding interface to serve as a sliding valve control system. The rotor plate rotates with the rotor-drum assembly within the housing.

The rotor plate 30 is configured having a number of openings therethrough (not shown) that align with respective openings in the cylinder bores. The stator plate 16 also comprises openings (not shown) that are in alignment with inlet and outlet ports (not shown) extending through the end block. As the rotor-drum 20 rotates within the housing, the rotor plate openings align with the stator openings to facilitate fluid inlet and outlet in a manner corresponding to the piston inlet and outlet strokes to provide the desired fluid transport by the pump.

Generally speaking, the internal components or parts of such RAPPs that are subjected to frictional forces during pump operation include the interface surfaces between the stator plate 16 and the rotor plate 30, the metallic interface surfaces between the swash plate 18 and the piston slippers 24, and the interface between the piston ball and the slipper As noted earlier, when the RAPP is configured for use in oil hydraulic transport service, such metallic interface surfaces are lubricated by the oil being transported, which operates to reduce the frictional forces existing at the metallic interfacing surfaces.

Design of RAPPs is complex and involves tradeoffs between an inherent set of problems arising from the liquid pressures and the moving interface surfaces described above, and these have given rise to many different approaches. Assuming the capability requirement to be a well-defined constant (essentially input/output pressures, flow rate and RPM), efficiency and reliability become of main concern in meeting the usual requirements of overall (initial, operating, long-term) cost effectiveness and reliability. Since efficiency depends heavily upon sealing and lubrication, and these two tend to be mutually exclusive in the design of practical RAPPs, the unsatisfactory extent and nature of tradeoff and compromise that must be accepted in the present state of the art in this field of endeavor indicate an unfulfilled need for further improvement.

RAPPs as disclosed herein are specially designed and engineered to function in water hydraulic transport service, where lubrication within the pump is provided by water rather than oil or any additives. The challenges associated with this type of service application relate primarily to addressing the friction forces that develop within the pump at the noted interfacing surfaces during use.

Past approaches at designing RAPPs for such surface have focused on using a combination of plastic and metal for all bearing or interface surfaces, e.g., by placing a polymeric surface or surface feature on one or more of the interface surfaces. While this approach has had some effect, the polymeric surface features are very sensitive to and are subject to being damaged or worn away during operation by the presence of particulate matter in the water. In the presence of even fine particulates, the plastic material can prematurely wear out and result in catastrophic failure of the RRAP. Therefore, such RAPPs configured in this manner require that the water entering the pump be prefiltered to a high degree, e.g., be ultra-fine, to provide a desired service life.

RAPPs as disclosed herein are specially designed and engineered having a more robust design, enabling such RAPPs to provide an improved service life in water hydraulic transport service without the need for fine prefiltration of the water, thereby permitting a broader spectrum of use in a manner that is also less costly.

Figure 2:
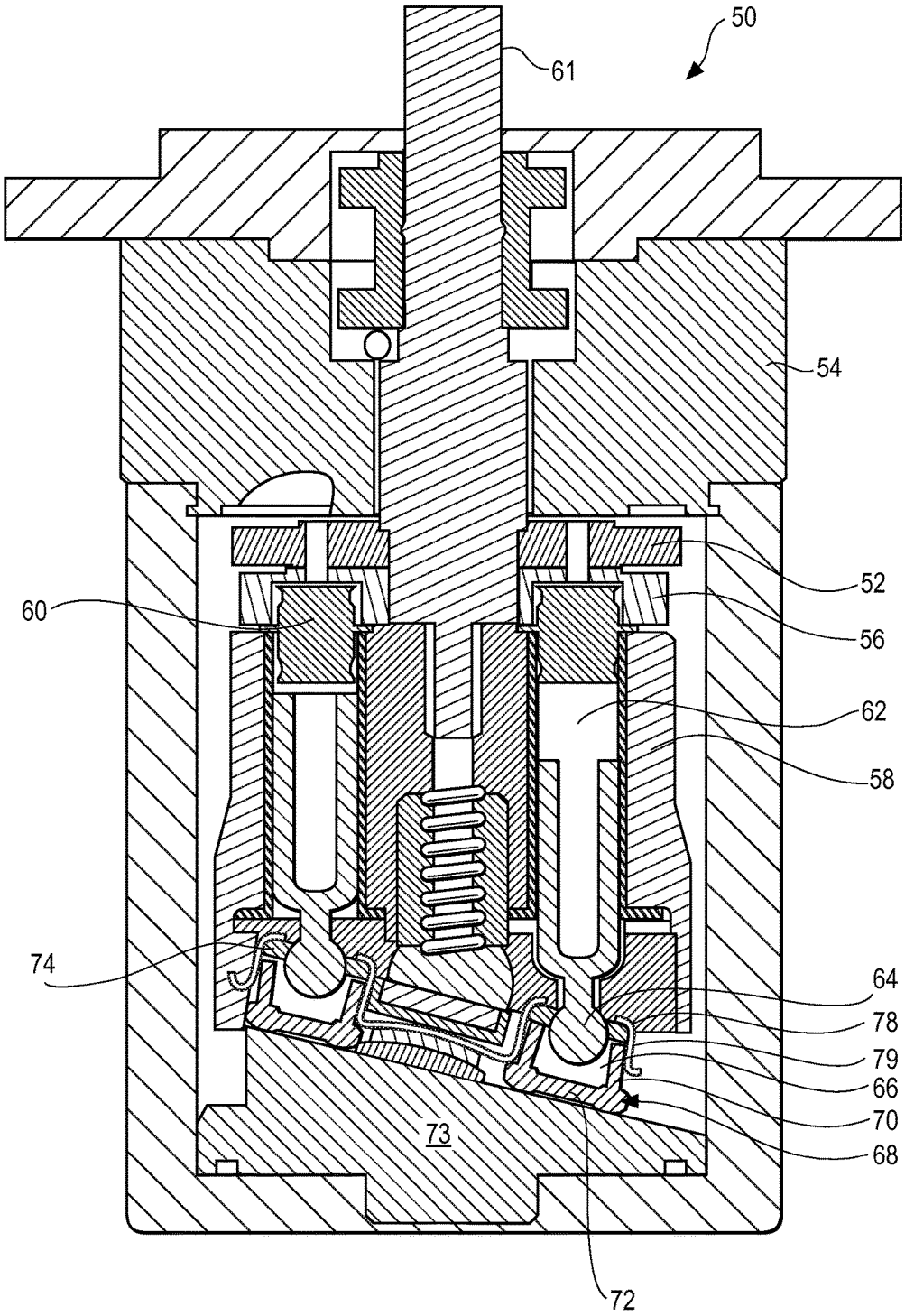
FIG. 2 illustrates a cross-sectional view of an RAPP as disclosed herein.

FIG. 2 illustrates an example embodiment RAPP 50 as disclosed herein. For purposes of focusing on the internal components of the RAPP, the housing is not shown but is understood to exist. The RAPP comprises a stator plate 52 that is positioned against the end block 54, and a rotor plate 56 that is interposed between the stator plate 52 and the rotor-drum 58.

In an example embodiment, the stator plate 52 comprises a ceramic surface that interfaces with the rotor plate 56. The stator plate 52 can be made entirely from a ceramic material or can be a composite construction comprising a metal body and having a ceramic layer (e.g., in the form of a veneer or the like) covering all or a portion of the interface surface with the rotor plate and/or covering all or a portion of the interface surface with the end block. If desired, the layer can be provided in the form of a continuous surface or can be provided in the form of one or more surface features projecting outwardly a distance from the surface to contact the rotor plate. In a preferred embodiment, the stator plate is entirely formed from a ceramic material.

In an alternative embodiment, the stator plate is formed from a metallic material and comprises a ceramic layer disposed over all or part of at least the rotor plate interface surface. In stator plate embodiments comprising a ceramic layer, i.e., when the entire stator plate is not formed from a ceramic material, it is desired that such layer have a thickness that is sufficient to provide a desired degree of low-friction service to provide a desired effective service life without unnecessarily adding to the material costs. In an example embodiment, it is desired that the ceramic layer or ceramic surface feature have a thickness of at least 0.03 inches, and preferably in the range of from about 0.03 to 0.1 inches.

The stator plate comprises inlet and outlet ports to facilitate the flow of fluid into and out of the RAPP by cooperation and alignment with fluid openings in the rotor plate during operation of the RAPP. Ceramic materials useful for forming the stator plate or being used to form a ceramic layer on the one or more surfaces of the stator plate include metal oxides and metal carbides. Examples of preferred ceramic materials include but are not limited to aluminum oxide, silicon carbide, tungsten carbide and combinations thereof.

The rotor plate 56 can be formed from a metallic material. In an example embodiment, the rotor plate may have a metallic body comprising a ceramic layer along a stator rotor interface surface. In such embodiment, the rotor-drum interface surface may be metallic. In a preferred embodiment, the rotor plate 56 comprises a stator interface surface comprising a ceramic layer. Such layer can be continuous or can be provided in the form of surface features projecting outwardly from the rotor plate surface. Thus, a preferred RAPP embodiment comprises bearing surfaces formed between the stator plate and rotor plate that are both made from ceramic material.

Like the stator plate, the rotor plate 56 can alternatively be formed entirely from ceramic material, i.e., a monolithic ceramic construction. As noted above, the rotor plate can have a composite construction comprising a metal body and having a ceramic layer (e.g., in the form of a veneer or the like) covering all or a portion of the interface surface with the stator plate. In embodiments where the rotor plate comprises a ceramic layer or surface feature, the thickness of such layer or surface feature is the same as that disclosed above for the stator plate. In a preferred embodiment, the rotor plate is entirely formed from a ceramic material. The ceramic materials used to form all or part of the rotor plate are selected from the same group of ceramic materials disclosed above for the stator plate.

The rotor plate 56 includes a number of openings that are configured to accommodate respective nipples 60 therein that are interposed between adjacent cylinder bores and rotor plate openings. The nipples are preferably cylindrical annular members that may be formed from a metallic material, and that have an outer diameter sized to fit inside a portion of the adjacent cylinder bore and rotor plate opening to facilitate the passage of fluid therebetween. The nipples include seals that are positioned around the outside diameter to form a leak-sight connection with the adjacent inside surfaces of the rotor plate opening and cylinder bore.

The RAPP comprises a shaft 61 that extends from a position outside of the RAPP axially through the end block 54, through the stator plate 52 and through the rotor plate 56. The shaft 61 is used to rotate the rotor-drum and includes a reduced diameter section that projects axially from the rotor plate and is securely disposed within a central cavity of the rotor-drum. The rotor plate 56 is fitted to the shaft to rotate with the rotor-drum during shaft rotation. Configured in this manner, the rotor plate 56 does not move axially within the RAPP during operation.

The rotor-drum 58 is formed from a metallic material and comprises a number of cylinder bores 62 disposed axially therein. Pistons are disposed within respective cylinder bores 62. In an example embodiment the pistons are formed from a metallic material, preferably stainless steel. The nipples 60 are configured having a length that does not impair the stroke of the pistons within the respective cylinder bores. The pistons include ball-shaped ends 64 that project outwardly from respective cylinder bores 62.

The piston ball-shaped ends 64 are each disposed within a respective socket joint 66 of a slipper 68. Referring to FIGS. 3A to 3D in combination with FIG. 2, in an example embodiment, the slipper 68 has a body that is formed from a ceramic material. The ceramic material can be the same as that disclosed above for the stator and rotor plates. The body is configured having an upper cylindrical wall portion 70 that defines the socket joint 66. The socket joint includes a polymeric material, e.g., a plastic material, disposed therein that insulates the piston ball-end from the ceramic slipper body when the piston-ball end is disposed therein, thereby operating to reduce friction forces between the parts during RAPP operation.

In an example embodiment, the slipper and the socket joint polymeric material can be molded together at the same time. In another embodiment, the slipper and socket joint plastic material can be formed separately and assembled together for use within the RAPP.

The slipper body includes a swash plate interface element 72 in the form of a dish-shaped member positioned at the end of the upper cylindrical wall portion 70. In an example embodiment, the swash plate interface element 72 is formed from a ceramic material. In a preferred embodiment, the slipper body is a one-piece ceramic construction comprising the upper cylindrical portion and the swash plate interface element. Configured in this manner, the slipper comprises a swash plate interface element having a ceramic surface for interacting with a swash 73 plate. If desired, the swash plate interface surface can be configured having one or more surface features projecting therefrom. Such surface features can be configured to provide to further reduce the friction forces that occur during RAPP operation.

In an example embodiment, the swash plate interface surface comprises a surface feature in the form of a circular ridge 85 (best shown in FIG. 3C) that operates to reduce the interfacing surface area between the slipper and the swash plate. The inner portion of the ridge 85 can be pressurized through a channel 87 extending axially through the slipper and in communication with the process fluid to provide hydrostatic support during the piston's power stroke. During operation of the RAPP, such circular ridge operates to further reduce the friction forces developed between the dynamic slipper and swash plate interface by providing a thin separating film of fluid therebetween. In an example embodiment, the surface feature projects outwardly a distance of from about 0.01 to 0.06 inches, preferably about 0.02 to 0.03 inches.

While a slipper comprising a one-piece ceramic construction has been disclosed, in an alternative embodiment, the slipper may be configured having a composite construction or more than one material, wherein the swash plate interface surface is formed from a ceramic layer, e.g., a veneer, that is provided in a continuous layer or in the form of one or more surface features. For example, the slipper may comprise a metallic upper cylindrical wall construction, and the swash plate interface element may be formed from a metallic material having a ceramic swash plate interface surface, or the swash plate interface element may be formed entirely from a ceramic material.

In the example embodiment illustrated in FIG. 2, the slipper socket joint 66 is configured to accommodate a respective piston ball-shaped end therein, and a top-hat shaped retainer 78 is disposed over an opening of the socket joint to keep the piston ball-shaped end therein. A split ring 74 collar interlocks the top-hat retainer over the ball joint. The top-hat retainer 78 can be made from a metallic or ceramic material, and in a preferred embodiment is made from a metallic material. The retainer in this particular embodiment operates to keep the piston ball-shaped end within the slipper socket joint during operation of the RAPP.

Alternatively, and as illustrated in FIGS. 3A to 3G, the slippers can be configured having a socket joint that is configured to retain the piston ball-shaped end therein without the need for a top-hat retainer. In such slipper embodiment, the upper cylindrical wall is configured having an inwardly directed lip. When the socket joint include the plastic material, the lip has a dimension that is slightly smaller than the piston ball-shaped end diameter, to retain the piston ball-shaped end when it is disposed within the socket joint, thus avoiding the need for the top-hat retainer.

As illustrated in FIG. 2, the slippers 68 are held in position and place against a swash plate 73 by the use of a pressure plate 79. The pressure plate is configured for placement over a top portion of the slippers to impose a desired biasing force onto each of the slippers. The biasing force is provided by a spring member 80 that is disposed axially within a central cavity 82 of the rotor-drum, and that is interposed between the rotor-drum and the pressure plate.

A feature of the RRAP disclosed herein is that spring providing the biasing force does not contact the rotor plate. Rather, the spring 80 is interposed between and in contact with the rotor-drum and the pressure plate. These construction features enables the rotor plate to be made from a ceramic material or comprise a ceramic layer to provide the desired degree of friction force reduction between the bearing surfaces, rather than having to make the rotor-drum itself out of a ceramic material. Thus, this construction features provides an RAPP having a more cost effective replacement element if damaged or worn, i.e., the rotor plate rather than the entire rotor-drum.

Figure 3A:
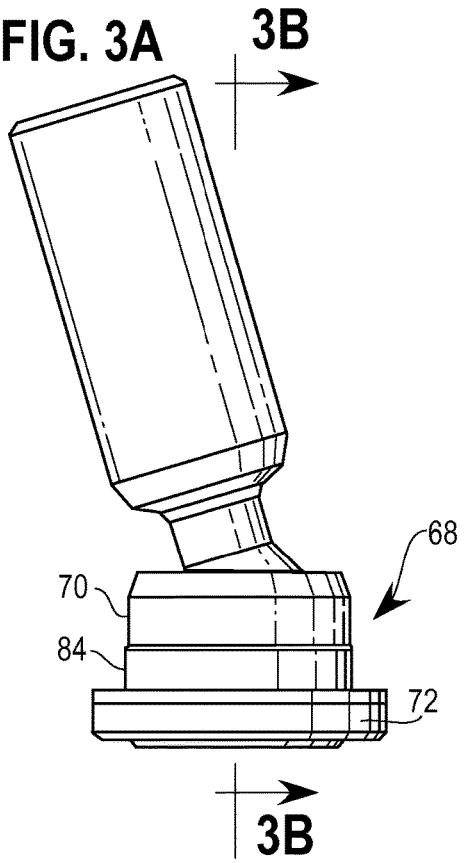
FIGS. 3A to 3G illustrate different views of a RAPP slipper as disclosed herein.
Figure 3B:
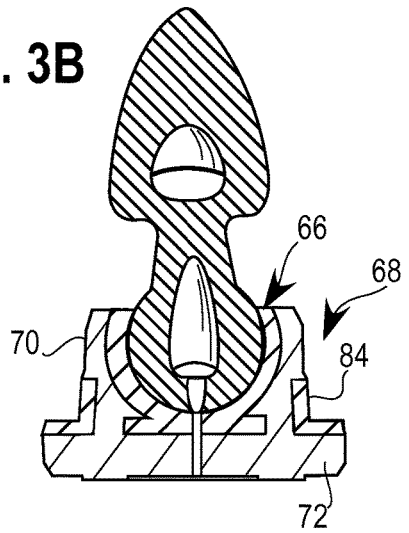
Figure 3C:
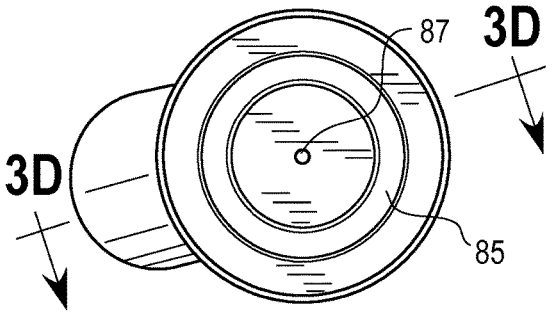
Figure 3D:
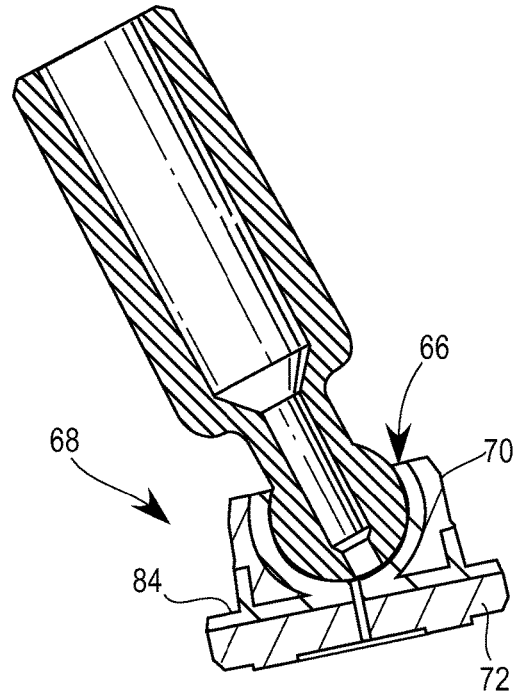
Figure 3E:
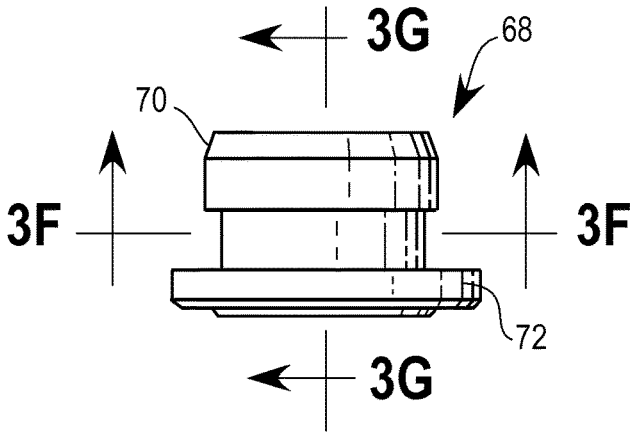
Figure 3F:
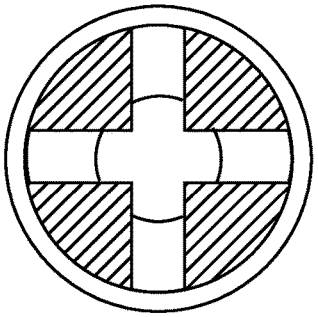
Figure 3G:
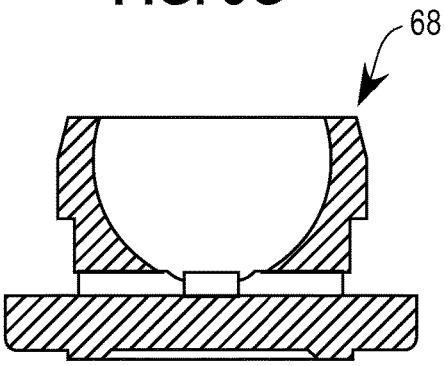

Referring to FIGS. 3A, 3B and 3D, the slipper optionally includes a bumper 84 that is positioned along an outside surface to accommodate placement of the pressure plate thereon. In an example embodiment, the bumper extends along an outside surface of the upper cylindrical portion and/or the swash plate interface element, and can be formed from a polymeric material such as that disposed within the socket joint. Channels of polymeric material interlock the socket joint and bumper. Slippers as illustrated in FIG. 2, that are configured making use of retainers 74, may or may not include such bumper, or the bumper may be disposed along a surface of the retainers. Alternatively, the embodiments of the slipper and/or retainers may not include the bumper, e.g., when the pressure plate is configured having a bumper or plastic material disposed along a slipper or retainer interface surface.

Referring to FIG. 2, the swash plate 73 comprises an inclined slipper interface surface and is disposed between the rotor-drum and a closed-end of the RAPP housing. In an example embodiment, the swash plate comprises a ceramic slipper interface surface. The entire swash plate can be configured from a ceramic material, i.e., have a monolithic ceramic construction, or the swash plate can have a composite construction, e.g., having a metal body, wherein the slipper interface surface comprises a ceramic layer, e.g., a veneer. The ceramic layer in such a composite construction can be continuous or provided by one or more surface features. The ceramic material can be selected from the same ceramic materials already disclosed above. In a preferred embodiment, the swash plate comprises a monolithic ceramic construction.

A feature of RAPPs as disclosed herein is that the internal bearing surfaces, existing between the stator and rotor plates, and the slippers and swash plate, are all characterized by having ceramic-to-ceramic surfaces. The selective use such ceramic materials, to either entirely form these internal components or form only the interfacing surfaces between these internal components, provides a desired improved reduction of friction forces between such internal components that not only permit use of such RAPPs in water hydraulic transport applications, but that enables such use without the need for high levels of entering fluid pretreatment, i.e., ultra-fine levels of filtration.

Thus, RAPPs designed and constructed in this manner enable more robust RAPP service in water hydraulic transport applications with improved service life and without pretreatment, thereby avoiding the costs and expenses associated with purchasing, operating, and maintaining such pretreatment equipment.

RAPPs as disclosed herein may be embodied and practiced in other specific forms without departing from the spirit and essential characteristics thereof. The present embodiments disclosed and illustrated herein are therefore to be considered in all respects as illustrative and not restrictive.

What is claimed is:

1. A rotary axial piston pump comprising:

a housing;

a swash plate, the swash plate having an inclined surface formed from a ceramic material;

a rotor assembly positioned adjacent the swash plate, the rotor assembly comprising a metallic rotor-drum having at least one cylinder bore disposed therein, and having metallic piston(s) disposed within the respective cylinder bore(s), the pistons having a ball-shaped end extending from the cylinder bore(s);

at least one slipper formed from a ceramic material and interposed between the swash plate and the rotor-drum, the slipper(s) comprising socket joints for accommodating the piston ball-shaped end(s) therein, the slipper(s) having a swash plate interface surface in contact with the swash plate inclined surface and formed from a ceramic material, and wherein the slipper socket joint comprises a plastic material disposed therein that is in contact with the piston ball-shaped end;

a stator plate positioned adjacent an end block disposed in the housing open end; and a rotor plate interposed between the stator plate and the rotor-drum;

wherein the stator plate comprises an interface surface in contact with the rotor plate that is formed from ceramic material, and wherein the rotor plate comprises an interface surface in contact with the stator plate that is formed from a ceramic material.

2. The pump as recited in claim 1 wherein the stator plate is formed from a ceramic material.

3. The pump as recited in claim 1 wherein the rotor plate is formed from a ceramic material.

4. The pump as recited in claim 1 wherein the swash plate is formed from a ceramic material.

5. The pump as recited in claim 1 comprising a pressure plate in contact with the slippers, and a spring in contact with the pressure plate, wherein the spring is disposed within a central cavity in the rotor-drum and is interposed between a closed end of the cavity and the pressure plate.

6. The pump as recited in claim 1 wherein the slipper and socket joint are a molded together construction.

7. A rotary axial piston pump comprising:

a housing;

a swash plate disposed within the housing and having an inclined surface formed from a ceramic material;

a rotor assembly positioned adjacent the swash plate, the rotor assembly comprising a rotor-drum having at least one cylinder bore disposed therein, and having piston(s) disposed within the respective cylinder bore(s);

at least one slippers interposed between the swash plate and the rotor-drum, the slipper(s) accommodating attachment with respective piston(s) and having a swash plate interface surface formed from a ceramic material and in contact with the swash plate inclined surface;

means for urging the slipper(s) into contact against the swash plate inclined surface;

a stator plate positioned adjacent an end block disposed in the housing open end; and a rotor plate interposed between the stator plate and the rotor-drum;

wherein the pistons each have a ball-shaped end, wherein the ball-shaped end is disposed within a socket joint of a respective slipper, and wherein a plastic material is disposed within the socket joint and in contact with the ball-shaped end.

8. The pump as recited in claim 7 wherein the stator plate comprises a rotor plate interface surface that is formed from a ceramic material.

9. The pump as recited in claim 8 wherein the stator plate is formed from a ceramic material.

10. The pump as recited in claim 9 wherein the rotor plate comprises a stator plate interface surface that is formed from a ceramic material.

11. The pump as recited in claim 10 wherein the rotor plate is formed from a ceramic material.

12. The pump as recited in claim 7 wherein the stator plate comprises a rotor plate interface surface that is formed from a ceramic material, and wherein the rotor plate comprises a stator plate interface surface that is formed from a ceramic material.

13. The pump as recited in claim 12 wherein one or both of the stator plate and the rotor plate is formed from a ceramic material.

14. The pump as recited in claim 7 wherein the slipper is formed from a ceramic material.

15. The pump as recited in claim 7 wherein the slipper and socket joint are a molded together construction.

16. The pump as recited in claim 7 wherein the means for urging the pressure plate comprises a spring disposed within a central cavity in the rotor-drum, wherein the spring is interposed between a closed cavity end in the rotor-drum and the pressure plate.

17. The pump as recited in claim 7 further comprising a plurality of retainers disposed on top of respective slippers and interposed between the slippers and the pressure plate.

* * * * *